US007377054B2

(12) United States Patent
Milner et al.

(10) Patent No.: US 7,377,054 B2
(45) Date of Patent: May 27, 2008

(54) DISPOSABLE SOLE FOR THE SHOE OR FOOT OF A WEARER

(75) Inventors: Tammy S. Milner, Gastonia, NC (US); Curtis L. Milner, Gastonia, NC (US)

(73) Assignee: Tripco, Inc., Gastonia, NC (US)

( * ) Notice: Subject to any disclaimer, the term of this patent is extended or adjusted under 35 U.S.C. 154(b) by 26 days.

(21) Appl. No.: 11/133,082

(22) Filed: May 19, 2005

(65) Prior Publication Data

US 2006/0207123 A1 Sep. 21, 2006

Related U.S. Application Data

(60) Provisional application No. 60/662,043, filed on Mar. 15, 2005.

(51) Int. Cl.
*A43C 13/00* (2006.01)

(52) U.S. Cl. ..... 36/15; 36/7.5; 36/11.5

(58) Field of Classification Search ..... 36/7.5, 36/15, 11.5

See application file for complete search history.

(56) References Cited

U.S. PATENT DOCUMENTS 1,980,621 A * 11/1934 Innis ..... 36/11.5
2,985,970 A * 5/1961 McCarthy ..... 36/11.5
3,693,269 A * 9/1972 Guarrera ..... 36/15
3,903,620 A * 9/1975 Gillet ..... 36/25 R
6,640,465 B1 * 11/2003 Burgess ..... 36/15

OTHER PUBLICATIONS

Crown, "Clean Step Dirt Grabber Mat with 60-Sheet Pad, Pad Refills", www.cleansweepsupply.com, published prior to Jan. 22, 2005, 1 page.

Kleenfeet, "Welcome to Kleenfeet!", www.kleenfeet.com, published prior to Jan. 18, 2005, 8 pages.

Sticky Shoes, "The Original Stickyshoe", www.stickyshoes.com, published prior to Mar. 4, 2004, 4 pages.

Shoplet.com, "Dirt Stop Scraper Mat", www.shoplet.com, published prior to Jun. 18, 2005, 4 pages.

* cited by examiner

*Primary Examiner*—Ted Kavanaugh
(74) *Attorney, Agent, or Firm*—Schwartz Law Firm P.C.

(57) ABSTRACT

A disposable protective sole is adapted for wear on a foot or shoe of a user. The protective sole includes a multilayer composite having opposing inside and outside major surfaces. The outside major surface is textured to resist slippage of the protective sole on an underlying surface. A pressure-sensitive adhesive is applied to the innside major surface of the composite, and is adapted for removably attaching the protective sole to the foot or shoe of the user.

8 Claims, 7 Drawing Sheets

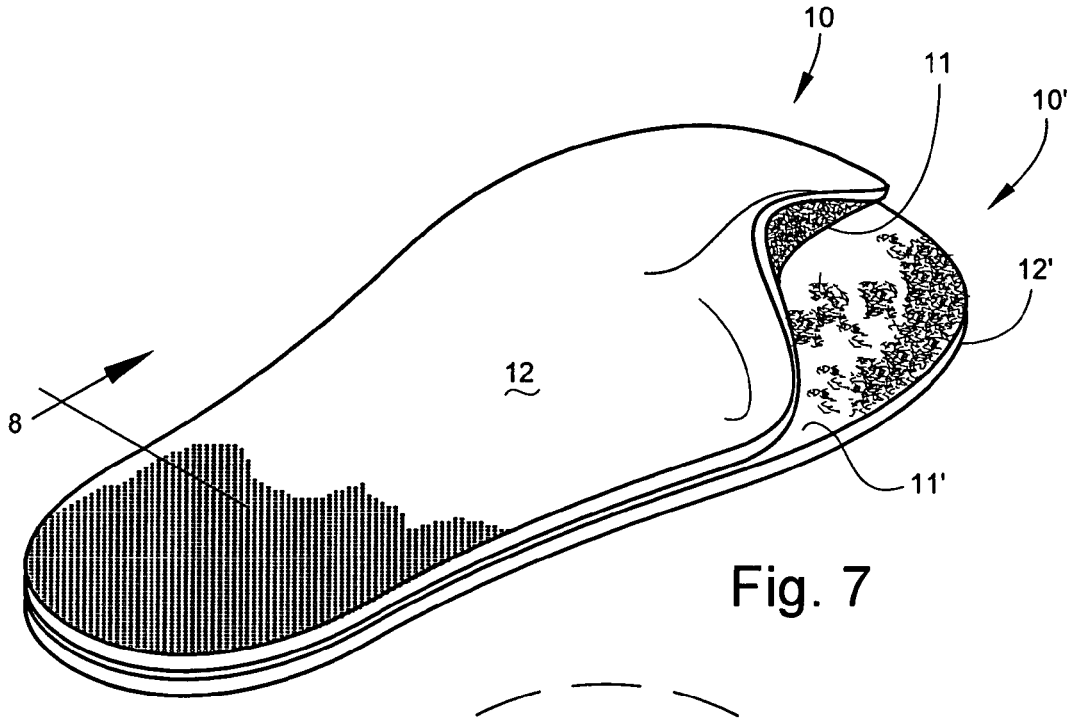
Fig. 7
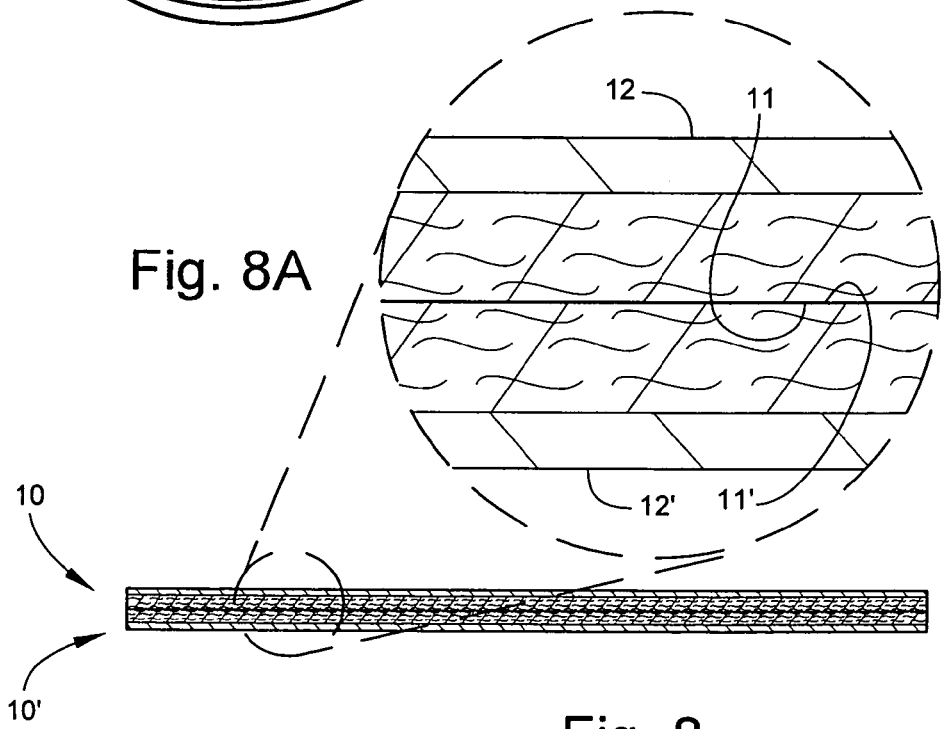
Fig. 8A
Fig. 8

DISPOSABLE SOLE FOR THE SHOE OR FOOT OF A WEARER

TECHNICAL FIELD AND BACKGROUND OF THE INVENTION

This invention relates to a disposable, protective sole for wear on a shoe or foot of a user. The invention serves to limit the exchange of elements, such as dirt, grime, and other loose debris, between the foot/shoe and an underlying surface. In one example, the invention is used to protect carpeting, rugs, and other floor surfaces in a newly constructed residence. In this case, the invention may be quickly and conveniently applied directly to the outside bottom (outsole) of the shoes, and used as a protective "dirt barrier" between the shoes and floor surfaces. The invention addresses the inconvenience of removing the shoes before entering the home, and the awkward and often embarrassing request that visitors remove their footwear at the door before stepping inside.

In another preferred application, the invention may reduce exposure to harmful bacteria, germs, and other microorganisms commonly found in public areas, such as health club showers and facilities, community pools, public restrooms, and the like. In this case, the invention is adhered directly to the bare feet and operates as a protective shield to these harmful, and potentially fatal, outside elements.

SUMMARY OF THE INVENTION

Therefore, it is an object of the invention to provide a disposable protective sole applicable for wear directly on a bare foot of a user to reduce exposure to harmful bacteria, such as staphylococcus, germs, fungus, and other microscopic parasites of skin.

It is another object of the invention to provide a disposable protective sole which is especially applicable for use in the shower.

It is another object of the invention to provide a disposable protective sole applicable for wear on the shoe of a user to reduce the exchange of dirt, mud, grime and other debris between the shoes and a residence, building, or other location.

It is another object of the invention to provide a disposable protective sole which has a generic shape applicable for wear on either the left or the right foot/shoe.

It is another object of the invention to provide a disposable protective sole which is offered in multiple sizes; e.g., small, medium, and large.

It is another object of the invention to provide a disposable protective sole which is relatively inexpensive to manufacture.

It is another object of the invention to provide a disposable protective sole which is relatively inconspicuous when worn by a user.

It is another object of the invention to provide a disposable protective sole which is designed to cover only the sole of the foot or bottom of the shoe.

It is another object of the invention to provide a disposable protective sole which is available in a variety of colors and aesthetic designs including festive and holiday occasional themes.

It is another object of the invention to provide a disposable protective sole which can be custom cut to any desired size and shape.

It is another object of the invention to provide a disposable protective sole which is available in scented fragrances.

It is another object of the invention to provide a method of limiting an exchange of elements between a foot or shoe of a user and an underlying surface of a subject area.

These and other objects of the present invention are achieved in the preferred embodiments disclosed below by providing a disposable protective sole adapted for wear on a foot or shoe of a user. The protective sole has opposing inside and outside major surfaces, and a pressure-sensitive adhesive adapted for removably attaching the protective sole to the foot or shoe of the user.

According to another preferred embodiment, the protective sole includes antimicrobial fibers adapted for inhibiting growth of microorganisms.

According to another preferred embodiment, the antimicrobial fibers comprise silver.

According to another preferred embodiment, the outside major surface is textured to resist slippage.

According to another preferred embodiment, the protective sole comprises a fabric composite including a first relatively thick fabric layer and a second relatively thin fabric layer.

According to another preferred embodiment, the first fabric layer of the composite has a thickness greater than 0.125 inches.

According to another preferred embodiment, the second fabric layer of the composite has a thickness less than 0.125 inches; and preferably, about ⅓ the thickness of the first fabric layer.

According to another preferred embodiment, the second fabric layer of the composite comprises a perforated polypropylene fabric.

In another embodiment, the invention is a disposable protective sole adapted for wear on a foot or shoe of a user. The protective sole includes a multilayer composite having opposing inside and outside major surfaces. The outside major surface has means for resisting slippage of the protective sole on an underlying surface. A pressure-sensitive adhesive is applied to the inside major surface of the composite, and is adapted for removably attaching the protective sole to the foot or shoe of the user.

According to another preferred embodiment, the multilayer composite includes a cushion layer having a thickness greater than 0.125 inches.

According to another preferred embodiment, the means for resisting slippage includes a perforated polypropylene fabric.

In yet another embodiment, the invention is a releasably attached pair of overlying, disposable, protective soles adapted for wear on respective feet or shoes of a user. Each of the protective soles has an inside major surface and an outside major surface. The inside major surfaces reside in substantial overlying registration. A pressure-sensitive adhesive temporarily adheres the inside major surfaces together. Prior to use, the pressure-sensitive adhesive is substantially concealed and protected between the protective soles of the attached pair. Upon separating the protective soles, the pressure-sensitive adhesive is exposed on each of the inside major surfaces. The pressure-sensitive adhesive serves to removably adhere the protective soles to respective feet or shoes of the user.

In still another embodiment, the invention is a method of limiting an exchange of elements between a foot or shoe of a user and an underlying surface of a subject area. The method includes the step of exposing a pressure-sensitive adhesive carried by a disposable protective sole. Prior to entering the subject area, the disposable protective sole is adhered to the foot or shoe of the user. The protective sole is then worn while inside the subject area. After leaving the subject area, the protective sole is removed from the foot or shoe.

The term "elements" is defined broadly herein to include, for example, bacteria such as staphylococcus, fungus, microscopic skin parasites, germs and other microorganisms; and larger elements, such as dirt, mud, grime, debris, and the like.

BRIEF DESCRIPTION OF THE DRAWINGS

Some of the objects of the invention have been set forth above. Other objects and advantages of the invention will appear as the description proceeds when taken in conjunction with the following drawings, in which:

FIG. 7 is a perspective view of an attached pair of the disposable protective soles with a toe portion of one sole being pulled away to separate the soles prior to use;

FIG. 8 is a cross-sectional view of the attached protective soles taken substantially along line 8-8 of FIG. 7; and FIG. 8A shows an enlarged cross-section of the attached protective soles.

DESCRIPTION OF THE PREFERRED EMBODIMENT AND BEST MODE

Figure 1:
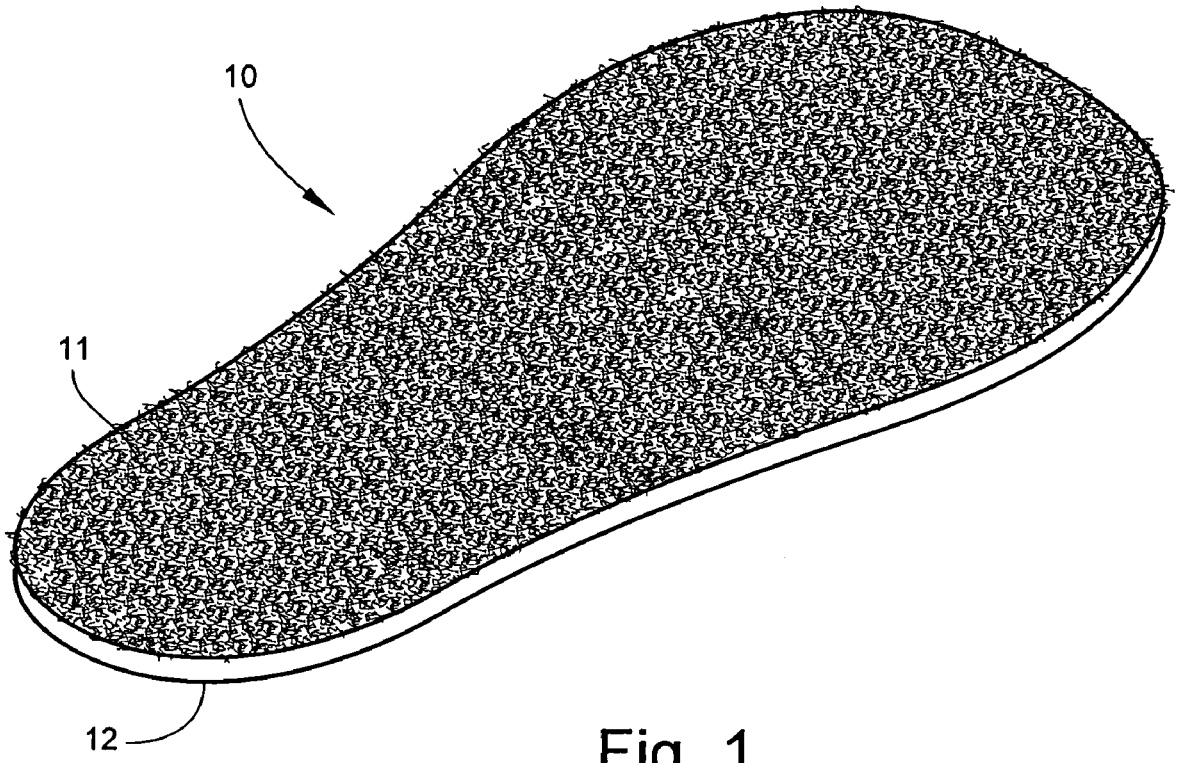
FIG. 1 is a perspective view of a disposable protective sole according to one preferred embodiment of the present invention.
Figure 2:
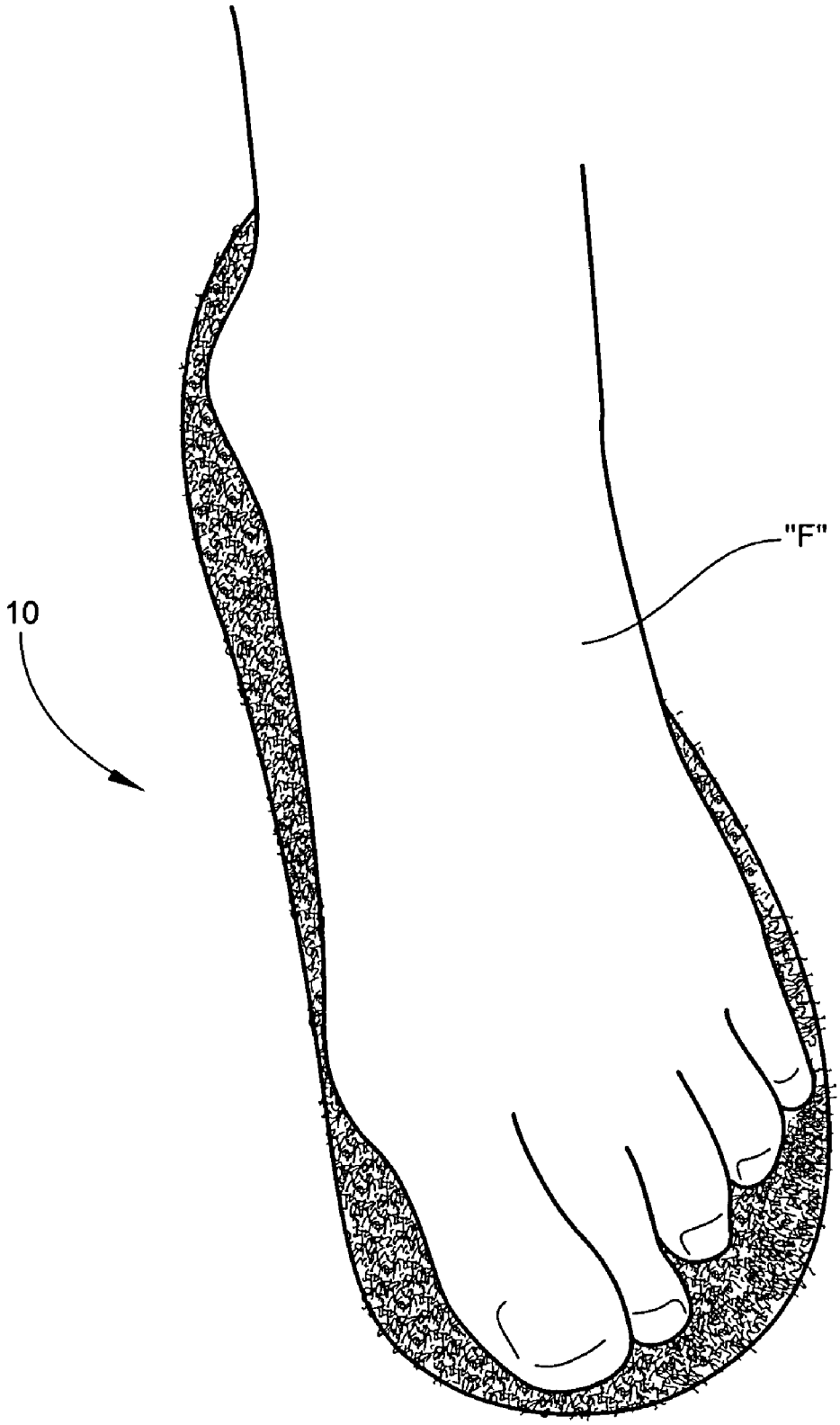
FIG. 2 is an environmental view of the protective sole adhered directly to a bare foot of a user.
Figure 3:
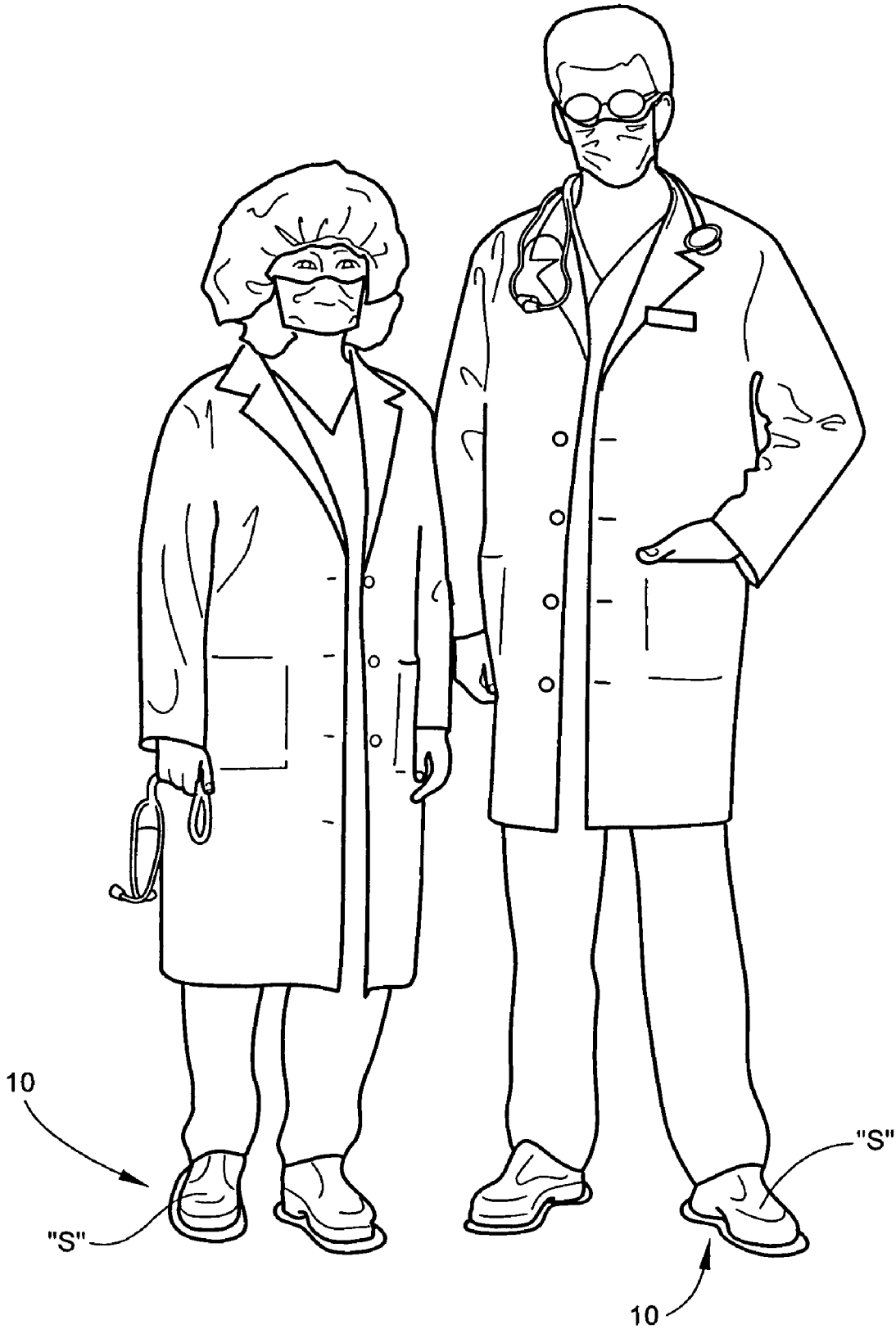
FIG. 3 is a further environmental view of the protective sole adhered directly to an outsole of shoe worn by a user.

Referring now specifically to the drawings, a disposable protective sole according to the present invention is illustrated in FIG. 1, and shown generally at reference numeral 10. The protective sole 10 has opposing inside and outside major surfaces 11 and 12, and a generic, generally bulbous-shaped design applicable for use of the sole 10 on either the left or right foot or shoe. FIGS. 2 and 3 demonstrate use of the protective sole 10 on the bare foot "F" and shoe "S" of the wearer, respectively. Optimally, the protective sole 10 is sufficiently large and wide to extend slightly beyond the entire "footprint" of the foot/shoe. The toe end of the protective sole 10 may also be turned slightly upwardly to avoid interfering with normal walking.

Figure 4:
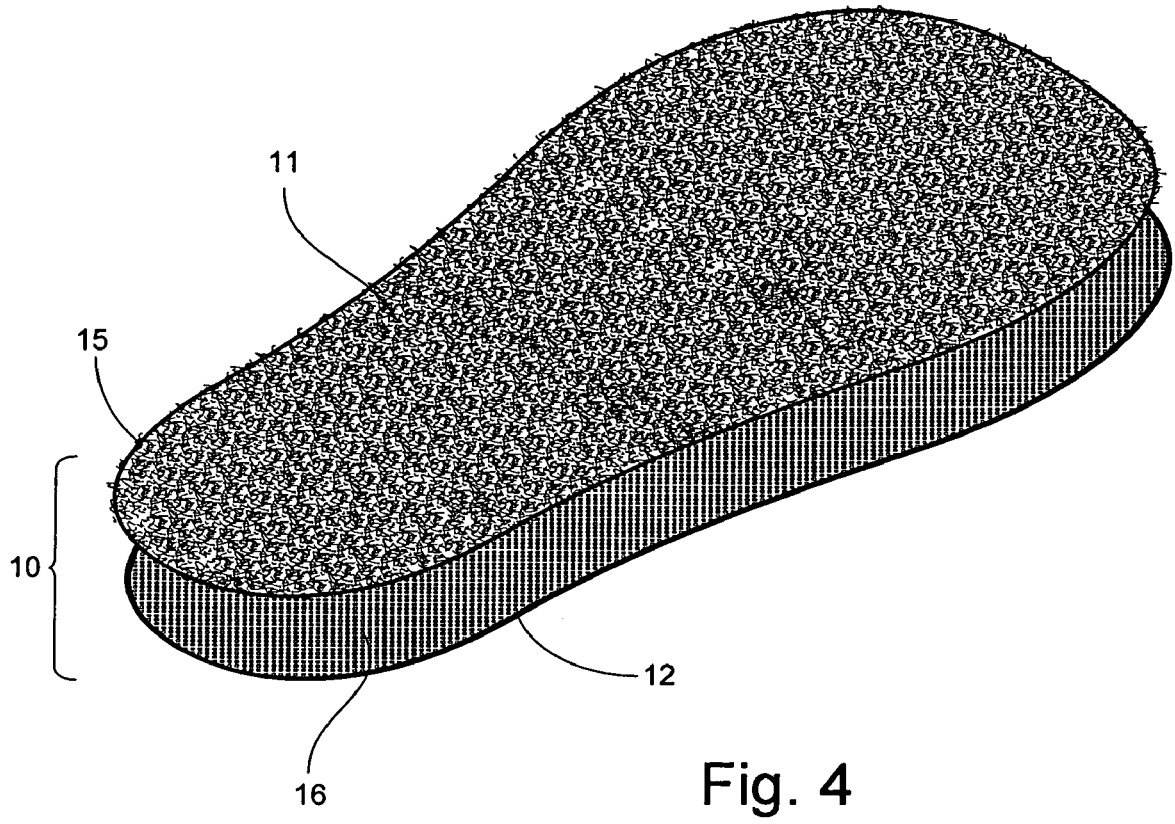
FIG. 4 is an exploded view of the protective sole showing the separate inside and outside layers of the fabric composite.
Figures 5, 5A:
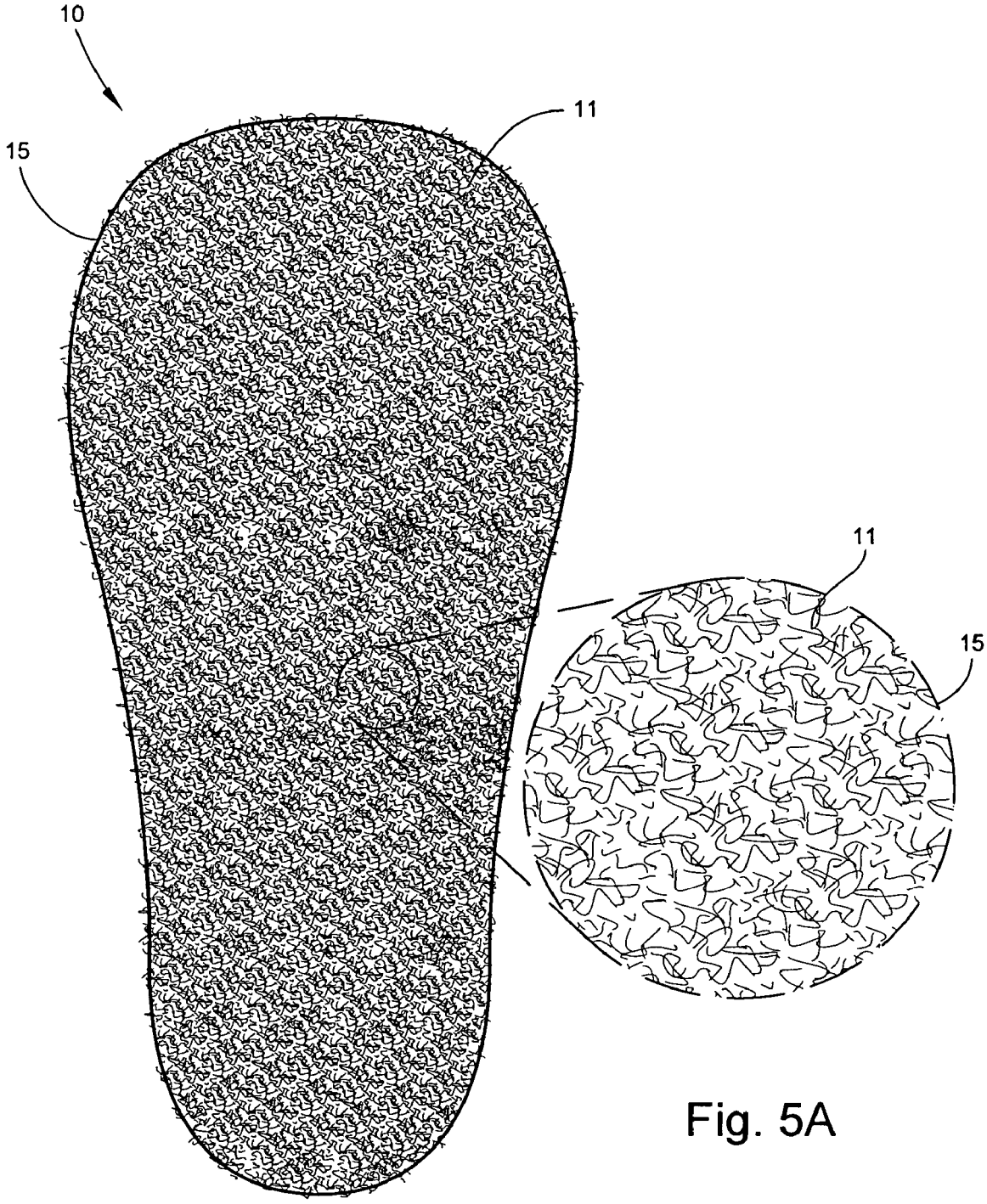
FIG. 5 is a top view of the protective sole showing its inside major surface.
FIG. 5A shows an enlarged portion of the inside major surface.

Referring to FIGS. 4, 5, and 5A, in one preferred embodiment, the protective sole 10 comprises a multilayer porous fabric composite including a relatively thick, nonwoven, cushion layer 15 and a relatively thin fabric backing 16. The cushion layer 15 is impregnated with a pressure-sensitive, non-transferable adhesive sufficient to securely and removably adhere the protective sole 10 directly to the bare foot or outsole of the shoe. Preferably, the adhesive covers the entire inside major surface 11 of the protective sole 10, and is completely effective when exposed to water. The thickness of the cushion layer 15 ranges from 0.125 to 0.250 inches. Preferably, for added health benefits, the cushion layer 15 further comprises antimicrobial fibers, such as silver, and may also be impregnated with aloe or topical medication for the foot.

Figures 6, 6A:
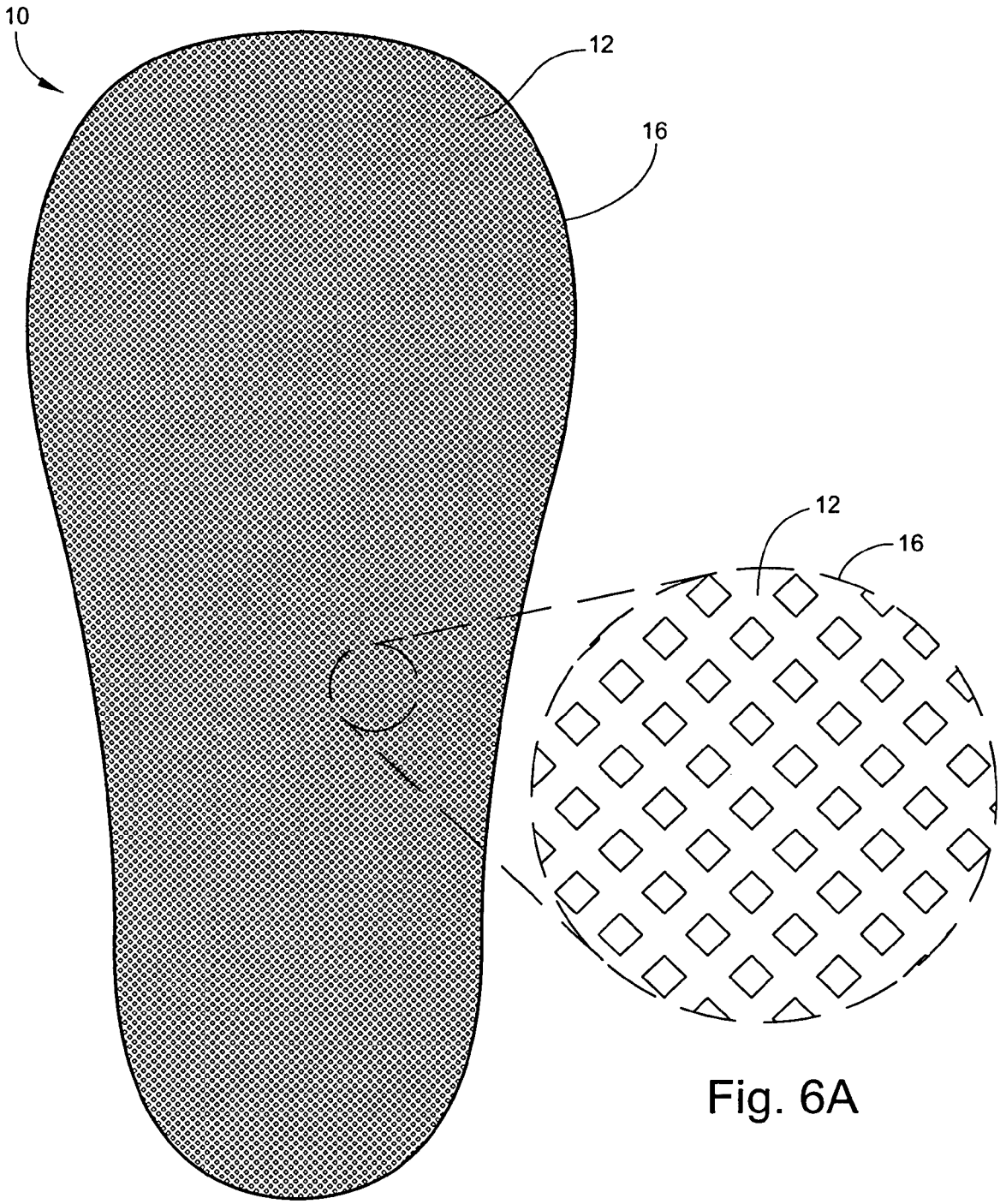
FIG. 6 is a bottom view of the protective sole showing its outside major surface.
FIG. 6A shows an enlarged portion of the outside major surface.

The thin fabric backing 16 of the composite is "wed" to the cushion layer 15 by any suitable means including adhesive, sewing, heat welding, or the like. According to one embodiment, the backing 16 comprises a perforated polypropylene fabric having sufficient tack or friction to prevent slippage of the protective sole 10 on hard surfaces, such as wood, tile, and vinyl floors. The perforated fabric, best shown in FIG. 6 and 6A, promotes breathability and enhanced comfort of the protective sole 10 when worn directly against the bare foot. The thickness of the fabric backing is preferably less than 0.125 inches. In addition, the fabric backing 16 may comprise a number strategically-spaced friction pads (not shown) located on the outside major surface 12 of the protective sole 10 for increased slip-resistance. Alternatively, the backing 16 may comprise a textured rubber, silicone, or other suitable material which offers substantial slip-resistance in a wet environment, such as a tile bathroom and shower.

As shown in FIGS. 7, 8, and 8A, the protective sole 10 is preferably stored and packaged in pairs with respective inside major surfaces 11 and 11' of the soles 10 and 10' in direct overlying contact to cover and protect the adhesive prior to use. To use the invention, the wearer pulls the soles 10 and 10' apart to expose the inside major surface 11, 11' of each sole 10, 10'. The separated soles 10, 10' are then dropped to the floor with the outside major surface 12, 12' facing down. The wearer then steps on the inside major surface 11, 11' of each sole 10, 10' to temporarily adhere the sole 10, 10' to the foot or shoe. After use, the soles 10, 10' are removed from the feet/shoes and discarded. Alternatively, a separate peel-away release paper backing (not shown) may be used to releasably cover the adhesive prior to use.

A disposable protective sole is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

We claim:

1. A releasably attached pair of overlying, disposable, protective soles adapted for wear on respective feet or shoes of a user, each of said protective soles comprising an inside major surface and an outside major surface, the inside major surfaces residing in substantial overlying registration, and a pressure-sensitive adhesive temporarily adhering the inside major surfaces together, such that:

i. prior to use, the pressure-sensitive adhesive is substantially concealed and protected between the protective soles of the attached pair; and ii. upon separating the protective soles, the pressure-sensitive adhesive is exposed on each of the inside major surfaces;

whereby, said pressure-sensitive adhesive serves to removably attach the protective soles to respective feet or shoes of the user.

2. A pair of disposable protective soles according to claim 1, wherein each protective sole comprises antimicrobial fibers adapted for inhibiting growth of microorganisms.

3. A pair of disposable protective soles according to claim 2, wherein said antimicrobial fibers comprise silver.

4. A pair of disposable protective soles according to claim 1, wherein the outside major surface of each protective sole is textured to resist slippage.

5. A pair of disposable protective soles according to claim 1, wherein each sole comprises a fabric composite including a first relatively thick fabric layer and a second relatively thin fabric layer.

6. A pair of disposable protective soles according to claim 5, wherein the first fabric layer of each protective sole has a thickness greater than 0.125 inches.

7. A pair of disposable protective soles according to claim 5, wherein the second fabric layer of each protective sole has a thickness less than 0.125 inches.

8. A pair of disposable protective soles according to claim 5, wherein the second fabric layer of each protective sole comprises a perforated polypropylene fabric.

* * * * *